United States Patent [19]

Steinke

[11] 4,428,442

[45] Jan. 31, 1984

[54] ROCK BIT LUBRICATION SYSTEM

[75] Inventor: Stephen C. Steinke, Miami, Ariz.

[73] Assignee: Smith International, Inc., Newport Beach, Calif.

[21] Appl. No.: 378,965

[22] Filed: May 17, 1982

[51] Int. Cl.[3] ..... E21B 10/22

[52] U.S. Cl. ..... 175/228; 175/337; 384/93; 384/318

[58] Field of Search ..... 175/227, 228, 337, 229; 384/93, 318

[56] References Cited

U.S. PATENT DOCUMENTS 2,751,196 6/1956 Smith ..... 175/228

2,831,660 4/1958 Smiecinski ..... 175/228

*Primary Examiner*—Ernest R. Purser

*Assistant Examiner*—Michael Starinsky

*Attorney, Agent, or Firm*—Robert G. Upton

[57] ABSTRACT

This invention relates to rotary rock drilling apparatus, particularly roller cone rock bits used with dry drilling of rock formations. Mining bits are typically air-driven, air-lubricated roller cone rock bits having open bearings, the air being driven through the bearing system between the roller cones and their associated journals. A lubrication system is disclosed which drips a lubricant in liquid form into the air passages communicating with each of the bearings associated with, for example, the three roller cones of the rock bit. Oil is entrained, along with the compressed air, and is directed to the bearings for cooling and lubrication purposes.

4 Claims, 3 Drawing Figures

ROCK BIT LUBRICATION SYSTEM

BACKGROUND OF THE INVENTION

1. Field of the Invention

This invention relates to an open bearing rotary cone rock bits principally used in surface mines. In quarrying, the presence of liquid in the borehole is objectionable. Hence, open bearing, air-lubricated rock bits are utilized, especially since the normal depth of the borehole is only a few hundred feet.

More particularly, this invention relates to rotary cone air bits with an internal drip lubrication system to entrain lubricant along with compressed fluid or air directed to the bearings of the rotary cone rock bit.

2. Description of the Prior Art

There are many patents directed to the use of lubrication systems in both rotary cone sealed bearing rock bits that run in liquid or "mud" and open bearing rock bits that are cooled and lubricated by a fluid directed down a drillstem to the bit.

U.S. Pat. No. 2,751,196, issued to B. D. Smith, is directed to a lubrication system for a dry rock drilling bit. This invention is directed to an open bearing roller cone rock bit having a chamber in its upper portion for receiving compressed air and three cutter elements rotatably carried on the lower portion of the bit. The body also provides air passages that extend from the chamber adjacent the cutter elements, with ducts which extend from the chamber to the bearing passages formed between the cutter cones and their respective journals. A central cylinder extends into the chamber from a dome section of the bit body to receive air pressure from the chamber and outwardly to the borehole bottom. A reservoir is formed between the cylinder and the body in the chamber to receive liquid lubricant. The lubricant is directed to this reservoir down a drillstring and into the reservoir. The inner cylinder extends above the level of the liquid so that air is directed through the chamber and into the borehole bottom to remove detritus from the borehole bottom. The liquid lubricant is fed directly to the bearings between the cutters and the journals. Air pressure then forces lubricant into each of the respective bearings.

The present invention is an improvement over the foregoing patent in that it provides a lubricant reservoir in a chamber formed by the rock bit body. The reservoir feeds lubricant into the air passages, directed to bearings formed between the cutter cones, and their respective journals by directing a tube from the bottom of the oil reservoir into the top of the air passages communicating with the bearings of the rock bit. The oil is entrained by the air passing into the air cooling passages as the air is directed to the bearing area of the rock bit. The rock bit of the present invention thus receives the cooling effect of the fluid on air directed to the bearing passages, along with entrained oil that is dripped into the air passage as the bit works in a borehole—thus each of the roller cones on the bit are lubricated as well as cooled as the bit works in a borehole.

U.S. Pat. No. 3,924,695, issued to John R. Kennedy, discloses a rotary drill system for dry hole drilling with the use of an open bearing rotary cone rock bit. The system requires a fluid with oil entrained by the fluid and directed from the drilling rig down the drillstring into a chamber formed in the rotary cone rock bit. A separator is located centrally of the chamber within the rock bit body. The separator serves to separate the liquid entrained in the fluid from the air. The liquid essentially goes around a conically-shaped central device which allows air to enter the center of the separator body, the oil going outside of the body. The collected oil in the base of the chamber is directed to the bearings formed between the cone and the journal. The separated air then is directed through a nozzle in the bit body to the exterior of the bit to lift detritus material from the borehole bottom, up the outside of the drillstring and out of the borehole.

The instant invention has an advantage over this patent in that the fluid directed down the drillstring need not have entrained therein a lubricating constituent. By providing a reservoir of liquid that is dripped or entrained into the air bearing passages by compressed fluid, there is no necessity to entrain liquid into the compressed fluid at the rig platform. The air passing into the bearing passages for cooling purposes picks up oil dripped into the entrance to the air/lubricating passages, therefore carrying oil in measured amounts to the bearing surfaces while still providing the cooling effect of the fluid or air to the bearing areas associated with a rotary cone rock bit.

The present invention obviates the problems associated with both of the foregoing prior art patents in that it has the advantage of providing a source of lubricant within the rock bit itself while preserving the advantage of the air circulation system wherein air is directed through conduits that lead to the bearings formed between the rotary cones and their respective journals. The '196 patent essentially obviates the beneficial effect of the cooling air by filling all of the air bearing passages completely with liquid while the '695 patent requires that the pressurized fluid source at the top of the drilling rig be supplied with an oil constituent so that the oil is carried along with the compressed fluid as it is directed all the way down the drillstring into the drill bit.

Again, the instant invention has the advantage of the cooling air to the bearing surfaces along with a means to supply a measured amount of liquid lubricant to the bearings as the open bearing bit works in a borehole.

SUMMARY OF THE INVENTION

It is therefore an object of this invention to provide an open bearing rotary cone rock bit, principally used in mines, with a self-contained lubricating system to entrain measured amounts of lubricant along with cooling air to the bearing surfaces formed between the rotating cones and the journals associated therewith.

More specifically, it is an object of this invention to provide a container of liquid lubricant within the air chamber formed within the upper body of the rock bit. The fluid or air under pressure acts on the surface of the liquid within the container to drive measured amounts of lubricant into conduits that are directed to the entrance of the air tubes communicating between the cones and the journals that forms the bearing surfaces.

A rotary rock bit for dry rock drilling is disclosed. The rotary cone rock bits has a body which forms a chamber in its upper portion to receive compressed fluid or air from the drilling rig. One or more roller cutter cones are rotatably carried on journals extending from the lower portion of the bit body. Fluid passage channels communicate between the chamber and bearing surfaces formed between the cutters and their respective journals. The passages include open ended extended cylinders from the entrance to the channel passages to the interior of the chamber formed by the bit body.

A lubrication means is formed within the chamber. The lubricating means directs liquid lubricant to the open ends of the housings or cylinders so that the compressed fluid or air, acting on the surface of the lubricant, forces lubricant through a conduit from the lubricating source to the open end of the housings. Thus air under pressure, entering the chamber, entrains a measured amount of lubricant into the passages comunicating with the bearing surfaces formed between the cones and their respective journals.

The advantage then over state of the art lubricating systems for air bits is the means in which a measured amount of liquid lubricant is directed into air cooling passages that lead to bearings between the cone and the journal, thus taking advantage of the cooling effect of the air or fluid under pressure while also gaining the benefit of lubricating oil in measured amounts to lubricate the bearing surfaces.

The above noted objects and advantages of the present invention will be more fully understood upon a study of the following description in conjunction with the detailed drawings.

DESCRIPTION OF THE PREFERRED EMBODIMENTS AND BEST MODE FOR CARRYING OUT THE INVENTION

Figure 1:
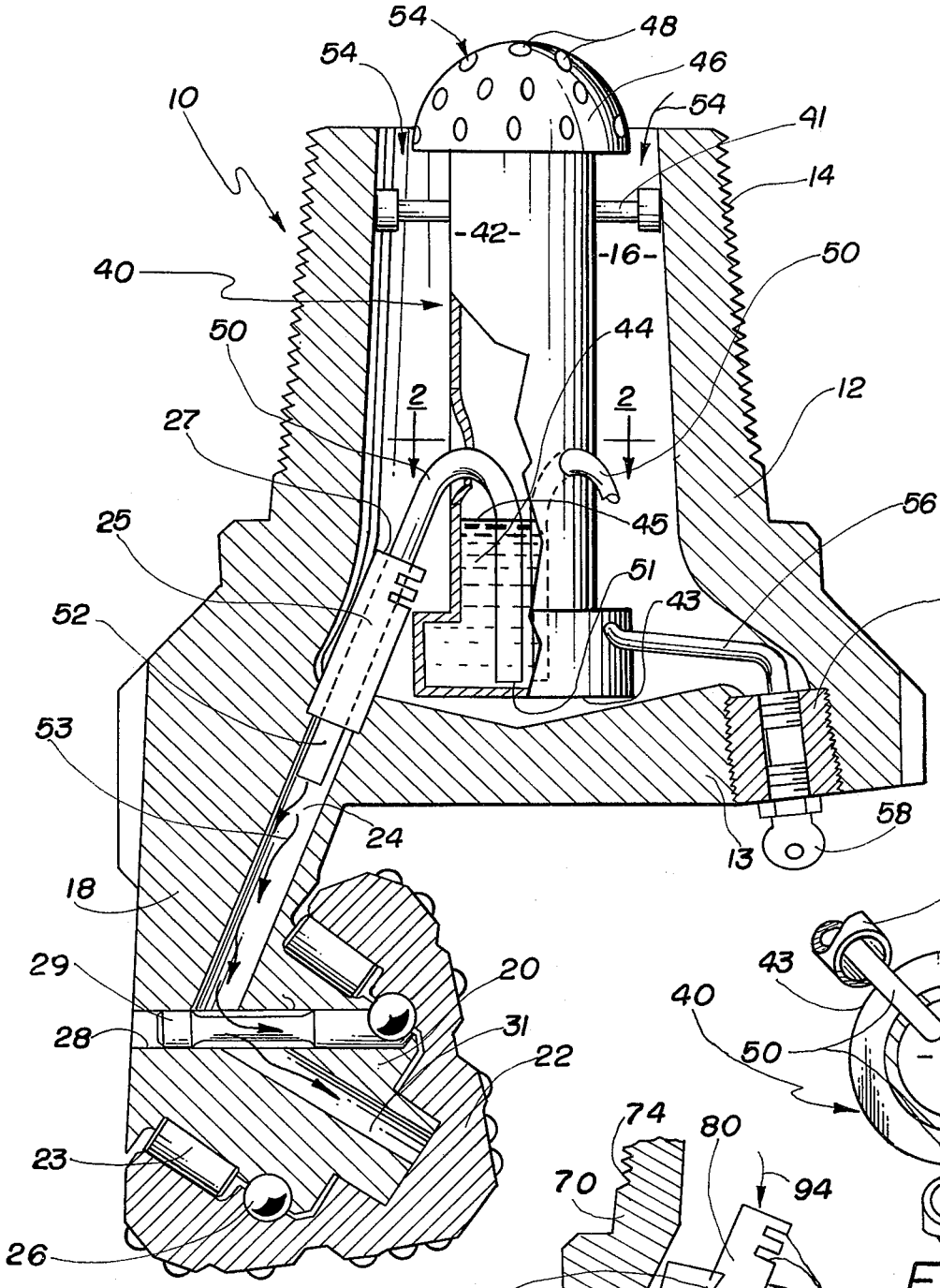
FIG. 1 is a partially cutaway view of the preferred embodiment of the present invention illustrated in a central container of lubricating liquid, the container directing lubricant in measured amounts into the openings leading to the bearings formed between the cone and the journal.

Turning now to FIG. 1, the open bearing rotary cone rock bit, generally designated as 10, consists of bit body 12, pin end 14 and leg portion 18 extending from body 12. Cantilevered from leg 18 is journal bearing 20. Cone 22 is assembled onto journal 20, incorporating a multiplicity of roller bearings 23. The cone 22 is retained on journal 20 by inserting a plurality of spherical ball bearings 26. The bearings 26 are inserted through ball hole 28, followed by insertion of ball plug 29 in the ball hole 28. A lube passage 30 is formed in the ball plug 29 to allow cooling air and entrained lubricant to pass by the ball plug into lube and air cooling passage 31 in journal 20.

An inner air chamber 16 is formed within body 12. The chamber 16 is open to a drillstring attached to the pin end 14 of bit 10. (The drillstring is not shown.) A series of air circulation holes 24 communicate between chamber 16 and the bearing surfaces formed between the cone 22 and the journal 20. At the entrance to the air/lubrication passage 24 is inserted a cylindrical tube or housing 25, the end 27 being cantilevered within chamber 16 of housing 12. The air circulation tube 25 serves to direct compressed fluid or air into air circulation conduit 24 to cool roller bearing 23 and other bearing surfaces formed between the cone 22 and journal 20. In the configuration as illustrated in FIG. 1, there would normally be three cones in 120° segments making up this particular bit. Obviously a similar air circulation chamber 24 would be communicating between chamber 16 and the two additional cone/journal combinations that are not shown.

In the preferred embodiment, a cylindrical lubrication retaining container, generally designated as 40, is positioned within chamber 16. The container 40 is comprised of base 43 and upper portion or crown 46. Within crown or cover cap 46 is formed a multiplicity of randomly positioned apertures to direct fluid or air from the drillstring into the interior of container body 42. A series of tube type conduits 50 communicate between the lube container 40 and the entrance 27 to air or fluid receiving tube 25. An inlet end 51 of conduit 50 is positioned adjacent the base or bottom 51 of lube container 42. The conduit is substantially axially aligned with the container body 42 and exits body 42 at a point that is above opening 27 of tube 25. The exit end 52 of conduit 50 is well within or substantially concentric with air/-lube passage 24 leading to the bearings. An identical tube 50 is directed to each of the other two roller cone journal combinations associated with a typical three cone bit (not shown). The interior of container 42 is filled with a lubricant in liquid form, such as TEX-CLAD, No. 2. This product is manufactured in White Plains, N.Y. It would be obvious to use other types of liquid lubricants within container 42 without departing from the scope of this invention. The lubricant may be admitted to the interior of container 42 through lube access fitting 57 which normally could be positioned within a fluid access hole, formed within dome area 13 of bit body 12. The lube access fitting 57 has, at its inlet end, a lube refill nipple 58 and, at its exit end, a fitting to direct liquid through lube refill conduit 56 and to base 43 of lubricant container 42.

It would be obvious to insert the container 42, with the interior of the container filled with a liquid lubricant, without having a lube refill fitting associated with the rock bit 10. Before the bit is assembled on the end of a drillstring, the filled lubricant container would be centrally positioned within chamber 16 of bit body 12 and secured in place through container attachment struts 41.

During operation, compressed fluid or air, generally designated as 54, is directed down a drillstring from a drilling rig at an air pressure of from 90 to 220 psi. Air 54 enters apertures 48 in lube container crown 46. The air within the container 42 is at a pressure of about 40 psi. The air pressure, subjected to the surface 45 of the lubricant 44 within container 42, is sufficient to force lubricant into opening 51 of conduit 50. A controlled amount of lubricant leaves exit end 52 of conduit 50 as the air 54 enters opening 27 of housing 25 under pressure. The air 54, passing the end 52 of lubricant conduit 50, entrains lubricant 44 along with the air 54 so that the combined lubricant and air 53 passes into the bearing areas defined between cone 22 and journal 20.

The internal passage diameter of conduit 50 will determine the rate at which lubricating oil 44 passes through conduit 50 into air/lubricating passage 24. The viscosity of the lubricant will also affect the rate at which the lubricant is entrained with the compressed air in channel 25. The lubricant entrained with compressed air allows the air to cool the bearing surfaces as originally intended while the oil serves to simultaneously lube the bearing surfaces, thus providing an open bearing rotary cone rock bit that will work longer and cooler within a borehole and providing a more efficient cutting dry rock drilling bit.

Figure 2:
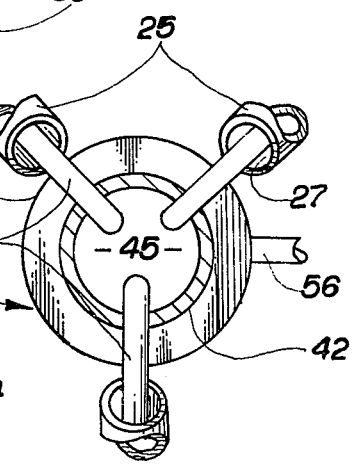
FIG. 2 is a view taken through 2—2 of FIG. 1 illustrating the conduits that lead from the interior of the lubricating cylinder to the opening for air under pressure so that the air entrains liquid in measured amounts, along with the cooling air to the bearing surfaces between the cone and the journal.

Turning now to FIG. 2, the section is taken through the container 42 at a point where lubricant conduits 50 come up from the bottom 43, through an opening in container 42 and into inlet opening 27 of each of the housings 25 to direct liquid lubricant in a controlled fashion to the bearings.

Figure 3:
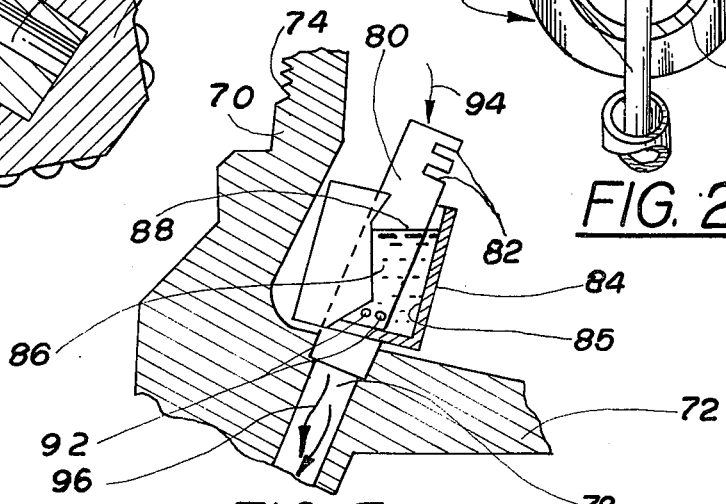
FIG. 3 is a partially broken away segment, in cross section, of an open bearing rock bit illustrating an alternative embodiment of the present invention.

FIG. 3 depicts another embodiment of the invention wherein housing 80 extends into chamber 76 of a rock bit body 70. The air or fluid 94 under pressure is directed into opening 82 of housing or tube 80. The air directed into fluid passageway 78 communicates between chamber 76 and the bearing formed between a cone and a journal (not shown). An open ended cylinder 84 is concentrically positioned over tube 80, the bottom 85 being connected or otherwise metallurgically bonded to the outer surface of the tube 80. Just above the bottom 85 is a series of apertures 92 drilled through the wall of tube 80. The apertures 92 direct liquid lubricant 86 into the interior of tube 80 and the air 94, passing through tube 80, entrains liquid lubricant in a controlled manner as the air or fluid under pressure passes by openings 92 in tube 80. Fluid under pressure is directed against surface 88 of lubricant 86, thus forcing the fluid through the apertures 92 into the interior of tube 80.

It would be obvious to pour liquid into the bottom of the chamber 16 of FIG. 1 and chamber 76 of FIG. 3, the bottom of these two chambers serving as a liquid lubricant reservoir. Tubes may then be directed from the oil reservoir formed in the chambers to the entrance 27 and 82 of the housing or tubes 25 and 80 as depicted in FIGS. 1 and 3 without departing from the scope of the invention. For example (with reference again to FIG. 1), the tubes 50 could be secured to the interior wall that forms chamber 16 with the bottom of the tube being just above the floor of the dome 13. The tube rises toward pin end 14 and curves concentrically within each of the housings or tubes 25. The tubes 50 are directed within the interior of tube 25 to entrain liquid droplets with air entering opening 27 of tube 25. It is however more convenient to provide a liquid retaining container, such as 40 and 84 of FIGS. 1 and 3, so that the rig operator would have the option of running pure compressed fluids to cool and lubricate the bearings between the cones and journals or the operator could insert the lubricant-filled container 40 or the lubricant container 84, surrounding fluid inlet tube 80 of FIG. 3, into the chamber of the bit. In other words, the rig operator, depending on his particular needs, has the option of either running the mining bit with or without the lubrication system as set forth with particularity in the present invention.

It will of course be realized that various modifications can be made in the design and operation of the present invention without departing from the spirit thereof. Thus, while the principal preferred construction and mode of operation of the invention have been explained in what is now considered to represent its best embodiments, which have been illustrated and described, it should be understood that within the scope of the appended claims, the invention may be practiced otherwise than as specifically illustrated and described.

I claim:

1. A rotary rock bit for dry rock drilling comprising:

a bit body forming a first opened pin end, said body further forming a chamber thereby, said chamber is in communication with said opened pin end of said body for receiving compressed fluid directed into said pin end of said body, at least one roller cutter cone rotatably carried by a journal extending from a second portion of said bit body, at least one fluid passage channel formed in said body, a first opened end of said channel communicates with the interior of said chamber, a second end of said channel communicates with bearing surfaces formed between said at least one cutter and its respective journal, at least one conduit tube forming first and second opened ends, a first end of said conduit tube is positioned in said first opened end of said channel, the second opened end of said conduit tube protrudes into the interior of said chamber to receive said compressed fluid directed into said chamber through said pin end of said body, and lubrication means within said chamber, said lubrication means directs lubricant through said opened end of said conduit tube into said fluid passage channel, said lubricant being entrained with said compressed fluid as said fluid passes into said bearing surfaces to cool and lubricate said bearing surfaces.

2. The invention as set forth in claim 1 wherein said lubrication means is at least one lubricant tube communicating between a reservoir of lubricant contained within said chamber and said conduit tube protruding into said chamber and positioned in said fluid passage channel, an end of said lubricant tube admits lubricant into said fluid passage through said second end of said conduit tube, said compressed fluid serves to entrain said lubricant within said fluid to cool and lubricate said bearing surfaces.

3. The invention as set forth in claim 2 wherein said lubricant is retained within a container forming a first base end and a second fluid receiving end, said container being substantially centrally positioned by container retention means formed by said bit body within said chamber, said lubricant container having one or more tubes that direct lubricant from an interior of said lubricant retaining container at said first base end, out of said container, into said second opened end of said conduit tube communicating with said fluid passage channel formed in said body.

4. The invention as set forth in claim 1 wherein said lubrication means within said chamber is a lubricant containing cylindrical housing with a first base end and a second open end, said cylindrical housing being substantially concentric with said at least one conduit tube communicating with said at least one fluid passage, said base end of said cylinder is connected to said conduit adjacent said first end of said conduit communicating with said fluid passage channel, said conduit forming one or more apertures through a wall of said conduit, said apertures communicate with an interior of said lubricant containing cylindrical housing, said lubricant within said housing is drawn through said apertures and entrained with said compressed fluid as said fluid passes into said fluid passage channels.

* * * * *